United States Patent [19]

Burgin et al.

[11] Patent Number: 4,476,589

[45] Date of Patent: Oct. 16, 1984

[54] VENTILATED HAT

[75] Inventors: Ralph C. Burgin, Westpoint, Iowa; David B. Cale, Hamilton, Ill.

[73] Assignee: Dadant & Sons Inc., Hamilton, Ill.

[21] Appl. No.: 321,813

[22] Filed: Nov. 16, 1981

[51] Int. Cl.[3] ..... A42B 1/18

[52] U.S. Cl. ..... 2/184.5; 2/177

[58] Field of Search ..... 2/184.5, 171.3, 177, 2/171.4, 171.7, 175, 410, 182.6, 425

[56] References Cited

U.S. PATENT DOCUMENTS

| | | | |
|---|---|---|---|
| 1,009,281 | 11/1911 | Cleary | 2/184.5 |
| 1,036,004 | 8/1912 | Revell | 2/184.5 |
| 1,062,668 | 5/1913 | Swanson | 2/184.5 |
| 1,955,986 | 4/1934 | Tice, Jr. | 2/184.5 X |
| 3,925,821 | 12/1975 | Lewicki | 2/171.3 X |

*Primary Examiner*—Peter P. Nerbun

*Attorney, Agent, or Firm*—Fred Philpitt

[57] ABSTRACT

This invention pertains to a helmet having a novel ventilating structure located in the dome-shaped portion of the helmet.

4 Claims, 4 Drawing Figures

VENTILATED HAT

BACKGROUND

A variety of semi-rigid helmet-type head coverings have been devised over the years. These helmets have been generally characterized by a wide brim extending outwardly from the lower periphery of a central dome-shaped portion, the main purpose of the wide brim being to shade the face of the wearer from sunlight. The wide brim usually extends from about one to three inches outwardly from the lower periphery of the central dome-shaped central portion. Some patents which show this type of helmet are: U.S. Pat. Nos. 1,860,690; 2,066,493; 2,074,568; 2,112,808; 2,117,764; and 3,092,837.

For the most part these helmets have been made from some sort of cellulosic product or byproduct including heavy paper, cardboard, pressed wood pulp, etc. One disadvantage of cellulosic helmets has been that they are usually not entirely waterproof and if the wearer is caught in the rain deterioration or damage to the helmet can occur. Another disadvantage of helmets made from cellulosic products is that they can easily become soiled by the ready absorption of dirt, grease, etc. and are not strong enough to withstand impacts or abusive wear. A further disadvantage of all helmets of this type as well as ones made from a synthetic plastics material is that since they are designed to be worn in the hot sun to shade the wearer's face, there can be a considerable heat buildup under the dome portion of the helmet, which can become quite uncomfortable to the wearer. Sometimes such helmets contain a few ventilating holes but the presence of a few holes is frequently inadequate to achieve the desired degree of cooling. Some prior patents which show ventilating holes in the dome portion of a helmet or hat are U.S. Pat. Nos. 1,036,004; 1,338,283; D-91,577; D-93,898; D-218,385 and D-226,745.

An object of this invention is to provide a helmet with improved ventilating means located in the dome-shaped portion thereof and which permits ample air circulation while at the same time protecting the wearer's head against rain.

THE PRESENT INVENTION

Considered in its broadest aspect, this present invention pertains to a helmet that includes a central dome-shaped portion that is convex in an upward direction, a brim portion extending outward and downwardly from the lower periphery of said central dome-shaped portion and ventilating means located in said dome-shaped portion, said ventilating means comprising a multitude of contiguous openings formed by an intersecting network of ribs and/or vanes, at least a portion of these ribs and/or vanes being non-vertical and having surfaces which are inclined in an outward and downward direction with respect to the interior of the helmet so as to facilitate the run-off of any rain that falls on the helmet.

Considered from another aspect, the present invention pertains to a helmet that comprises a central dome-shaped portion that is convex in an upward direction, a brim portion extending outward and downwardly from the lower periphery of said central dome-shaped portion and ventilating means located in said dome-shaped portion that comprises a multitude of contiguous tubular openings that permit air flow from the exterior of the helmet into the interior of the helmet in the form of a multitude of channelled air streams, said multitude of contiguous tubular openings being formed by (a) a plurality of generally vertical ribs of generally rectangular cross section that are spaced apart from each other in a generally parallel fashion, and (b) a vertical array of spaced apart vane members extending generally horizontally between each pair of vertical ribs, each vane being of generally rectangular cross section and having an upper surface that is inclined in an outward and downward direction with respect to the interior of the helmet so as to facilitate the run-off of any rain that falls on the helmet.

SPECIFIC DESCRIPTION OF THE INVENTION

The invention will be more clearly understood by reference to the attached drawings wherein.

Figure 1:
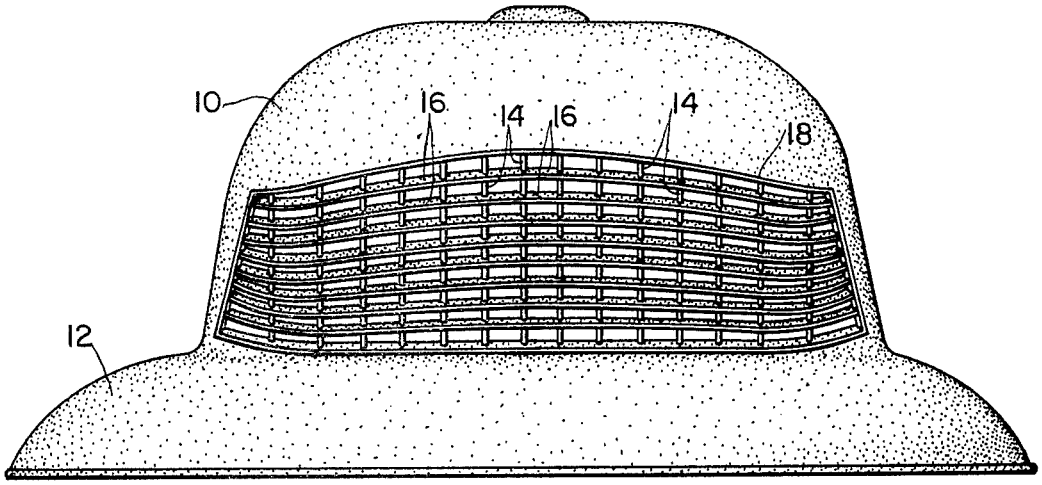
FIG. 1 is a side view of our helmet.

Referring now to the drawings, it will be seen that the helmet of the present invention comprises a central dome-shaped portion 10 that is convex in an upward direction. Around the lower periphery of the dome-shaped portion 10 there extends outwardly a brim portion 12 that may be between about 1 and 3 inches wide. The brimmed portion 12 is preferably curved slightly or shaped in the form of a slight arc, so as to slope outwardly and downwardly.

The two lateral sides of the dome-shaped portion each have a ventilator section provided therein which has a cross-sectional area of between about 2 and 30 square inches. The outline or outer shape or configuration of the perimeter of the ventilator section is not critical and can be of any desired shape. The general outline shown in the drawings is generally rectangular with slightly curved sides, but it can also be square, eliptical, diamond-shaped, star-shaped or instead of a single configuration can consist of a series of the aforementioned configurations.

The details of the construction of each ventilator section is also not critical and can be varied a great deal. In each ventilator section shown in the drawing a multitude of continguous tubular openings is formed by an intersecting network of ribs and/or vanes. At least a portion of such network (and preferably about half of the network) is composed of non-vertical ribs that have generally planar surfaces which are inclined in an outward and downward direction with respect to the interior of the helmet so as to facilitate the run-off of any rain that falls on the helmet.

More particularly, the multitude of contiguous tubular openings are formed by a plurality of generally vertical ribs 14 intersecting generally horizontal ribs or vanes 16. The vertical ribs 14 that are spaced apart from each other in a roughly parallel fashion. The outermost portion of each rib 14 has a generally rectangular cross section (when viewed from the side in FIG. 1). The ribs 14 are shown as having varying heights, although this is not necessary. A vertical array of spaced apart vane members 16 extend between each pair of vertical ribs 14, each vane member 16 is generally horizontally disposed and its outer most portion has a generally rectangular cross section (when viewed from the side in FIG. 1). The upper surface of each vane member 16 is inclined in an outward and downward direction with respect to the interior of the helmet so as to facilitate the run-off of any rain that falls on the helmet.

Figure 2:
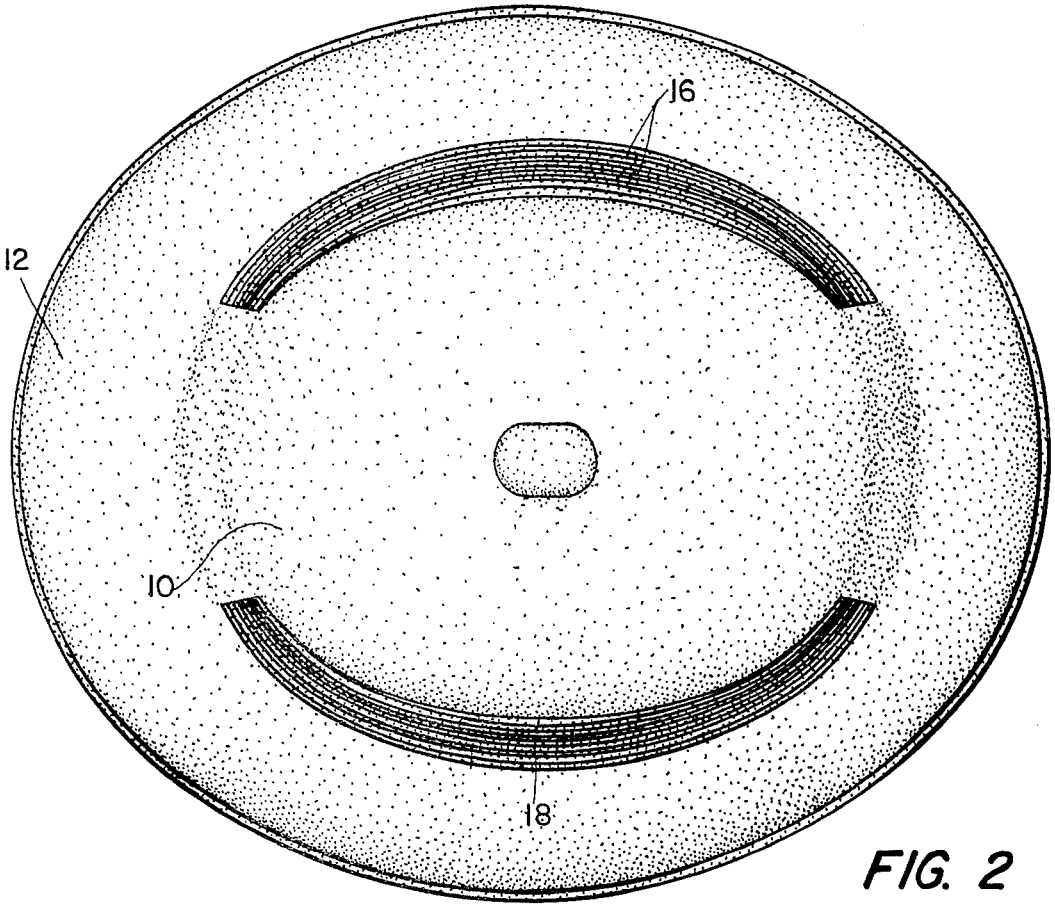
FIG. 2 is a top view of our helmet.

When viewed from above the pattern of the downwardly sloped series of horizontal vane members 16 appears as is shown in FIG. 2. As can be seen, these vanes are arranged so that each succeeding lower vane member extends outwardly beyond the one above it with the net result that a "cascade" effect is achieve and consequently when raindrops do fall on the helment they will move rapidly downwardly over the stepped pattern of vane members 16 and roll off the helmet without obstructing in any material way the ventilating capacity of the multitude of contiguous tubular openings. The exact angle at which the horizontal rib members are inclined donwardly from the inside to the outside of the helmet is not critical and may vary for example between 1° and 80°.

Figure 3:
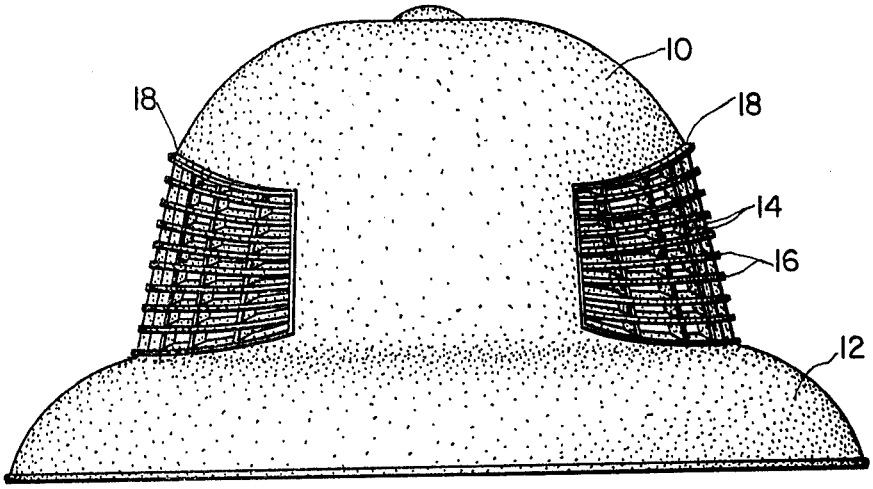
FIG. 3 is a front view of our helmet.
Figure 4:
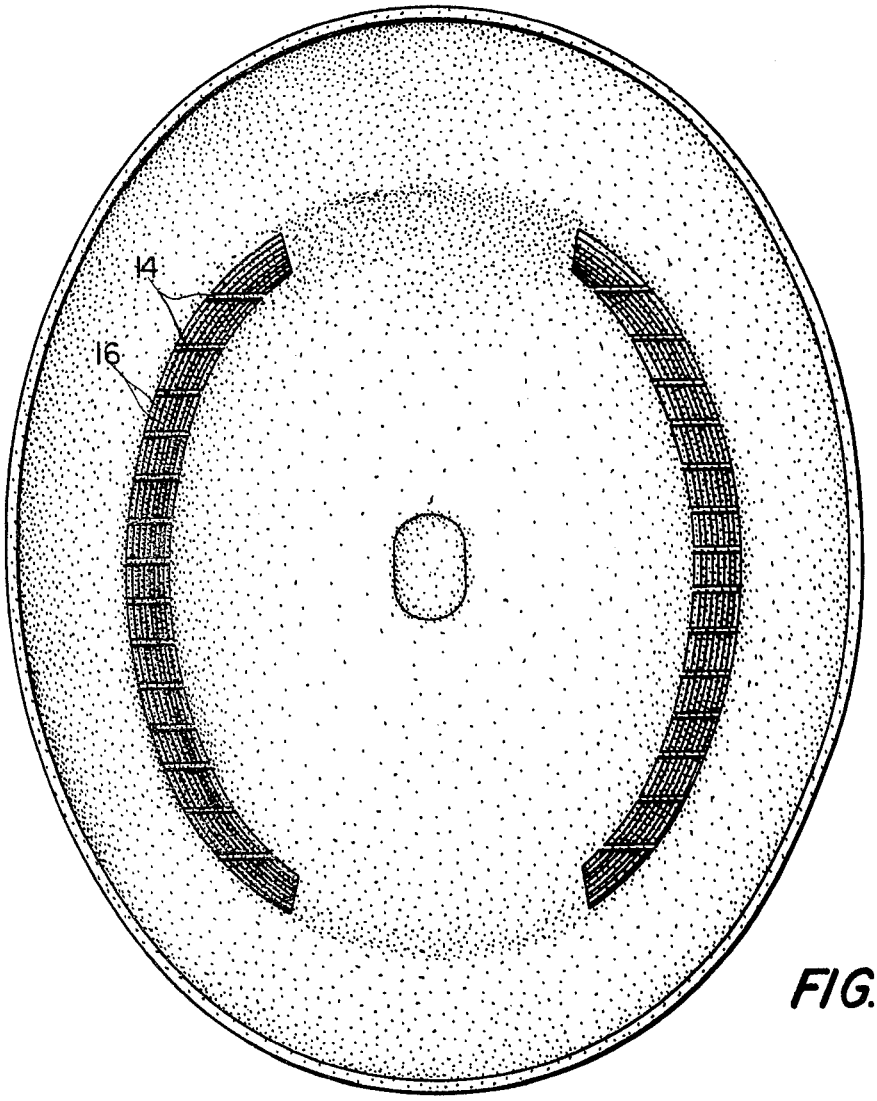
FIG. 4 is a bottom view of our helmet.

In the preferred embodiment shown in the drawings the outer portions of the ribs 14 are set back slightly from the outer edges of the vane members 16 (as is perhaps best shown in FIG. 3) so that they do not appear in a top view (FIG. 1). However their exact positioning is not critical and it will be understood that they could be located further out or further in than the positions shown.

The helmet of this invention also preferably contains a gutter or channel or inclined trough 18 located along the upper perimeter of each ventilation section. This gutter is curved downwardly from its high point near the mid-section of the helmet to lower points near the front and back of the helmet. The bulk of the raindrops hitting the very top of the helmet will thus be directed towards either the front or back of the helmt and will not have to flow over the tubular openings of each ventilator section. Gutter 18 can also serve as a support means for a beekeeper's veil that extends downwardly to the shoulders of the wearer of the helmet.

In the embodiment shown the tubular openings are seen to have a significant front-to-back dimension which is attributable to the fact that both the ribs 14 and the vane members 16 have a significant front-to-back dimension.

The helmet of our invention is preferably provided with means on the interior of the helmet to support the helmet at a spaced distance away from the wearer's head. Any support means known in the prior art can be utilized and since this is unrelated to the novel ventilating means, no specific support means has been shown. A preferred support means is disclosed in our copending application Ser. No. 363,620, now U.S. Pat. No. 4,443,892 and involves head band anchor members integrally formed on the inside of each helmet, the anchor members containing interconnection means for connecting to a separate adjustable head band.

The helmet of this invention is preferably made of plastic and suitably by an injection molding process. The helmet is rugged but comfortable. It is especially useful for beekeepers who use a veil in conjunction with a helmet because a veil often tends to inhibit the circulation of air from beneath the helmet brim.

While the outermost portions of the ribs 14 and the vanes 16 are shown in the drawings in their preferred form as each having a generally rectangular cross section (when viewed from the side) it will be apparent to those skilled in this art that the precise cross-sectional shape is not critical and can be varied so long as the main objective of shedding rain is not surrendered. For instance, the cross section might instead be made elliptical, tear-shaped, somewhat S-shaped, in the shape of an elongated "L", etc.

Likewise, while the tubular openings are shown in the drawings in their preferred form as being generally rectangular in configuration, these tubular openings might be of any other suitable configuration (e.g. triangular polygonal, etc) so long as the main objective of shedding rain is not lost.

As is evident from the drawings, an alternative way of describing the unitary helmet of our invention is that it comprises a central dome-shaped portion that is convex in an upward direction, a brim portion extending outward and downwardly from the lower periphery of said central dome-shaped portion, and two spaced apart sets of ventilating openings located in said dome-shaped portion, one set of ventilating openings extending along each side on the central dome-shaped portion of the helmet, each set of openings containing at least 100 separate openings of generally rectangular configuration, each separate opening being disposed in a generally vertical plane, the individual openings in each set being formed by the intersection of two generally spaced apart elongated vane members that extend generally horizontally from the front side of the helmet back to the rear side of the helmet, each of said vanes having a generally planar surface which is inclined in an outward and downward direction with respect to the interior of the helmet so as to facilitate the run-off of rain that falls on the helmet, the openings in each set being of such size and disposition that when one looks from the side of the hat toward the nearest set of openings the openings in the other side of the hat are clearly visible, which is an indication of the ease with which air can flow through the interior of the hat, whereby generally horizontal air flow from the exterior of the helmet to the interior of the helmet is permitted. It will be noted that the majority of said elongated vane members are higher at their mid-point than at either their front or back ends. In the specific embodiment shown in the drawings each set of ventilating openings contains 135 openings.

What is claimed is:

1. In a unitary helmet made entirely of plastic which comprises:

a central dome-shaped portion that is convex in an upward direction, a brim portion extending outward and downwardly from the lower periphery of said central dome-shaped portion and ventilating means located in said dome-shape portion, the improvement being that said ventilating means comprises two spaced apart sets of ventilating openings, one set extending along each side on the central dome-shaped portion of the helmet, each set of openings comprising at least 100 separate openings of generally rectangular configuration, each separate opening being disposed in a generally vertical plane, the individual openings in each set being formed by the intersection of two generally vertical spaced apart rib members with two spaced apart elongated vane members that extend generally horizontally from the front side of the helmet back to the rear side of the helmet, each of said vanes having a generally planar surface which is inclined in an outward and downward direction with respect to the interior of the helmet so as to faciliate the run-off of rain that falls on the helmet, said generally vertically spaced apart rib members each having portions that extend between said vane members over a length that produces openings of a certain size and disposition such that when one looks from the side of the hat toward the nearest set of openings the openings in the other side of the hat are clearly visible, which is an indication of the ease with which air can flow through the interior of the hat, whereby generally horizontal air flow from the exterior of the helmet to the interior of the helmet is permitted.

2. A helmet according to claim 1 wherein said ventilating means extends over an area of 2–30 square inches along each side of the helmet.

3. A helmet according to claim 1 wherein the majority of said elongated vane members are higher at their mid point than at either their front or back ends.

4. A helmet according to claim 1 wherein in each set of ventilating openings there are 135 openings.

* * * * *